US006820352B2

(12) United States Patent
Keidel et al.

(10) Patent No.: US 6,820,352 B2
(45) Date of Patent: Nov. 23, 2004

(54) WATERPROOF SHOE

(75) Inventors: Karsten Friedrich Keidel, Wuppertal (DE); Liviu-Mihai Pavelescu, Wuppertal (DE); Paul Edmund Raith, Ludwigsburg (DE)

(73) Assignee: Sympatex Technologies GmbH, Wuppertal (DE)

( * ) Notice: Subject to any disclaimer, the term of this patent is extended or adjusted under 35 U.S.C. 154(b) by 97 days.

(21) Appl. No.: 10/201,776

(22) Filed: Jul. 25, 2002

(65) Prior Publication Data

US 2003/0041474 A1 Mar. 6, 2003

(30) Foreign Application Priority Data

Sep. 5, 2001 (DE) ..... 101 43 575
Oct. 11, 2001 (DE) ..... 101 49 993

(51) Int. Cl.[7] ..... A43C 13/08
(52) U.S. Cl. ..... 36/12; 36/14; 36/21; 12/142 T
(58) Field of Search ..... 36/4, 12, 14, 21; 12/142 RS, 142 T

(56) References Cited

U.S. PATENT DOCUMENTS 4,505,660 A * 3/1985 Seidel et al. ..... 425/129.2
4,599,810 A 7/1986 Sacre
4,899,465 A 2/1990 Bleimhofer et al.
5,433,021 A * 7/1995 Mahler ..... 36/12
5,628,127 A * 5/1997 Notzold ..... 36/14
5,689,903 A * 11/1997 Aumann ..... 36/77 R
5,711,093 A 1/1998 Aumann
5,737,857 A 4/1998 Aumann
5,992,054 A * 11/1999 Rauch ..... 36/30 R
6,088,935 A * 7/2000 Pavelescu et al. ..... 36/14

FOREIGN PATENT DOCUMENTS

DE 295 18 124 U1 5/1996
DE 198 57 899 C1 10/2000
EP 0 298 360 A2 1/1989

* cited by examiner

*Primary Examiner*—M. D. Patterson
(74) *Attorney, Agent, or Firm*—Oliff & Berridge, PLC

(57) ABSTRACT

A shoe structure includes an upper made of an outer material, a waterproof and water vapor permeable functional layer, a lining, an insole, and an injection-molded sole. The upper has an extension made of a porous, permeable material and the insole is joined to the extension of the upper. The functional layer and the lining extend beyond a lower edge of the upper and only partially overlap the extension of the upper. The functional layer is spaced from an edge of the insole and the extension of the upper is penetrated by the material of the sole. A part of the functional layer extending beyond a lower edge of the upper is joined to the material of the sole, and a space between the functional layer and the edge of the insole is filled with the material of the sole as far as the interior of the shoe structure.

28 Claims, 5 Drawing Sheets

WATERPROOF SHOE

BACKGROUND OF THE INVENTION

The invention relates to a shoe structure and method of manufacturing such a structure having an upper comprising an outer material, a waterproof and water vapor permeable functional layer, a lining, an insole and an injection-molded sole. A lower edge of the upper has an extension comprising a porous and permeable material, and the insole is joined to this extension.

EP 0 298 360 A2 describes a shoe, wherein the outer material of an upper has an extension consisting of a porous, permeable material. It is expected that the resulting direct contact of the material of the sole with a functional layer will prevent penetration of water into a connecting seam joining an insole, a lining with a waterproof and water vapor permeable functional layer, and the extension of the upper.

It must be noted, however, that the density of the material of the sole changes during the flow of the still-liquid material of the sole through the extension of the upper consisting of a porous, permeable material. The material of the sole may begin to harden before an adequate joint with the functional layer is established. In such a case, a water bridge, extending to the connecting seam with the insole, forms between the functional layer and the material of the sole. Furthermore, it is been found that such shoes have poor antistatic properties.

Shoes having a sock-type lining, like those described, for example, in U.S. Pat. No. 4,599,810, have previously been suggested in order to ensure the watertightness of shoes. However, in addition to a problem of higher production costs, such shoes, particularly when used as safety shoes, show unacceptably poor antistatic properties. A static charge that frequently builds up on the wearer is discharged via the material to an unsatisfactory extent if the antistatic properties are poor, and not at all if the antistatic properties are very poor.

SUMMARY OF THE INVENTION

Embodiments of the present invention provide a shoe structure and method of making a shoe structure having an upper comprising an outer material, a waterproof and water vapor permeable functional layer, a lining, an insole and an injection-molded sole, wherein the waterproofing reliability and antistatic properties are improved and the cost of production is kept low.

DETAILED DESCRIPTION OF EMBODIMENTS

Figure 1:
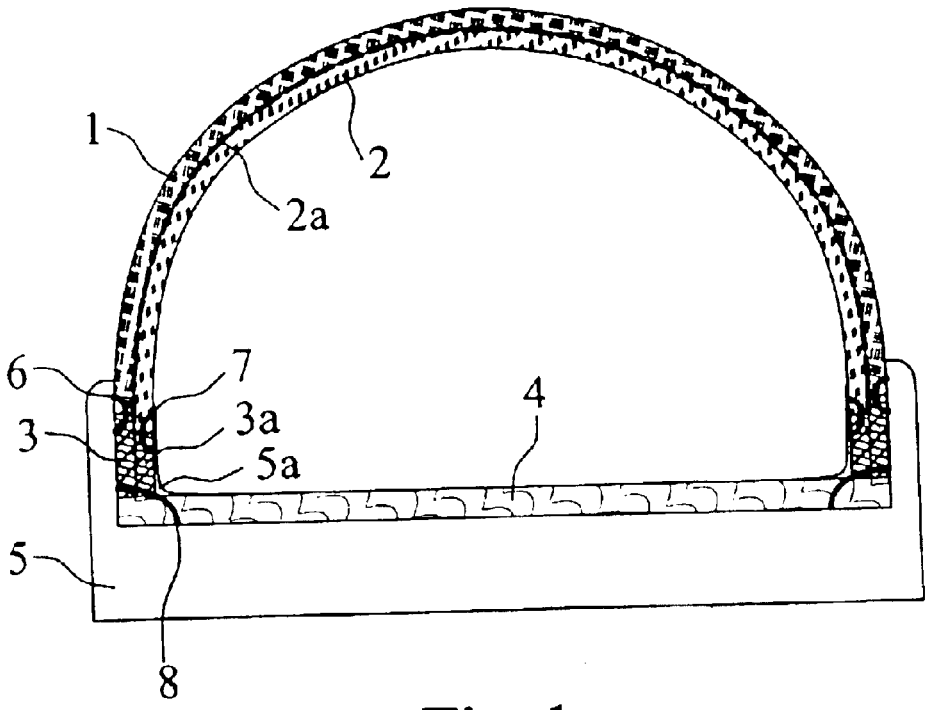
FIG. 1 represents a cross-section of a shoe showing a preferred embodiment of the present invention with two separate porous extensions.

An embodiment of the present invention is a shoe structure and method of manufacturing a shoe structure, wherein a functional layer and a lining extend beyond a lower edge of an upper, and only partially overlap an extension of the upper. In such an embodiment, the functional layer is spaced from the edge of an insole, such that material of the sole penetrates the extension of the upper, and a part of the functional layer extending beyond the lower edge of the upper is joined to the material of the sole. The space between the functional layer and the insole edge is filled in with the material of the sole as far as the interior of the shoe structure.

The functional layer may be either inserted separately into the upper or joined to the lining. A waterproof joint is obtained between the material of the sole and the functional layer because the material of the sole penetrates as far as the functional layer and is joined to it. For easier handling, the lower end of the functional layer may also be joined to the porous extension of the upper. However, the functional layer may also be joined to a further extension, e.g., a functional-layer extension, which is then joined on the other side to the insole.

In the embodiments described, the material of the sole penetrates as far as the interior of the shoe structure as a consequence of the functional layer being spaced from the insole. Such material of the sole has preferably undergone antistatic finishing in order to improve the antistatic properties. Thus, the antistatic effect extends into the interior of the shoe. It has also been found advantageous if the insole has also undergone antistatic finishing, at least in the region of the edge.

In another embodiment, the functional layer and the lining extend beyond the lower edge of the upper and only partially overlap the extension of the upper. In such an embodiment, the functional layer is spaced from the edge of the insole, the extension of the upper is joined to the insole, the extension of the upper is penetrated by the material of the sole, the part of the functional layer extending beyond the lower edge of the upper is joined to the material of the sole, the lining bridges the space between the functional layer and the edge of the insole and is joined to the insole, and the space between the functional layer and the edge of the insole is filled as far as the lining with material of the sole, which is joined to the lining.

It is particularly advantageous if the lining and/or insole is antistatic, at least in the region of the edge.

However, the material of the sole can be injection molded in such a way that the material of the sole also penetrates the lining as well. Under such circumstances, the material of the sole flows as far as the insole during manufacture, and the resulting strip of material of the sole in the interior of the shoe increases the electrical conductivity.

In any case, it is desirable while manufacturing the shoe that the material of the sole flows in the direction of the interior to such an extent that the thread of a seam joining the extension of the upper to the insole is completely enveloped, at least up to the lining in a region where the thread penetrates the extension, and that the edges of the outer material and functional layer are sealed. To achieve a good seal of the edge of the functional layer, the functional layer preferably extends beyond the outer material, so that the material of the sole envelops the edge of the functional layer after injection molding.

In FIG. 1, the shoe structure of the invention has an upper 1, a lining 2 having a waterproof and water vapor permeable functional layer 2*a*, an extension 3 of the upper, wherein the extension of the upper is made of a porous material, a porous extension 3*a* of the lining 2, and the functional layer 2*a*. The extension 3 of the upper is joined to the upper 1 by a seam 6. A further seam 7 joins the lining 2 and the functional layer 2*a* to the extension 3*a* of the lining. Extensions 3 and 3*a* are joined to the insole 4 by a seam 8. The material of the sole 5 penetrates extensions 3, 3*a* as far as the shoe interior 5*a* and envelops the three connecting seams 6, 7, and 8, as well as edges of the upper 1, functional layer 2*a*, and lining 2.

Figure 2:
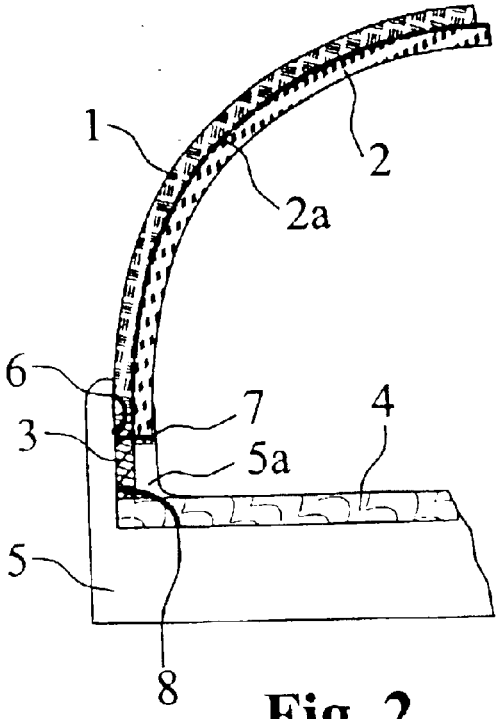
FIG. 2 represents a partial cross-section of a shoe according to an embodiment of the present invention with only one extension.

FIG. 2 shows a shoe structure similar to that shown in and described for FIG. 1. However, in the embodiment shown in FIG. 2, there is only one extension 3 of the upper. The upper 1 is sewn to the extension 3 of the upper by seam 6. The lining 2 and functional layer 2*a* are incorporated into the outer material of the upper and sewn to the extension 3 of the upper by seam 7. Seam 8 only goes through the insole 4 and the extension 3 of the upper.

Figure 3:
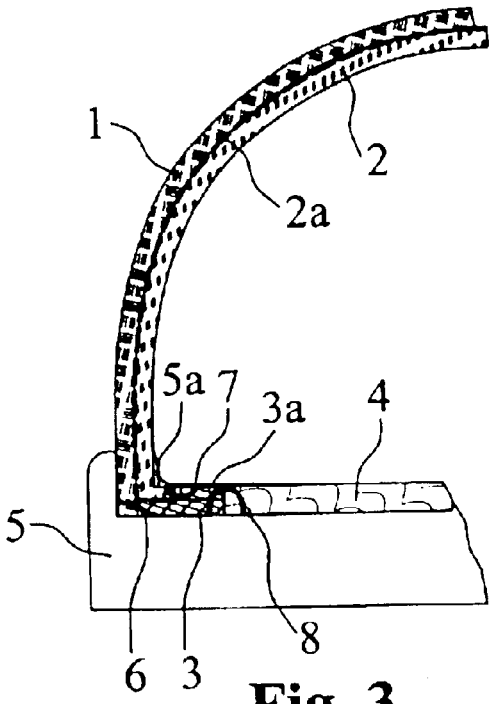
FIG. 3 represents a design for low-rise soles according to an embodiment of the present invention.

FIG. 3 shows a shoe structure having a low-rise sole. The structure is as described in FIG. 1, however, the extension 3 of the upper and extension 3*a* of the functional layer 2*a* and of the lining 2 are turned inward, and the insole 4 has a smaller perimeter.

Figure 4:
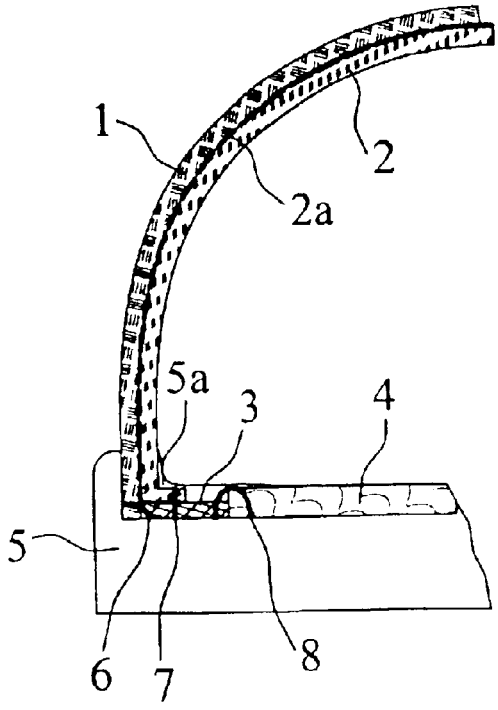
FIG. 4 represents a design for low-rise soles according to an embodiment of the present invention having only one extension.

FIG. 4 shows another embodiment having only one extension 3 of the upper for low-rise soles. The extension 3 of the upper is turned inward and the insole 4 has a smaller perimeter than that of the upper 1.

Figure 5:
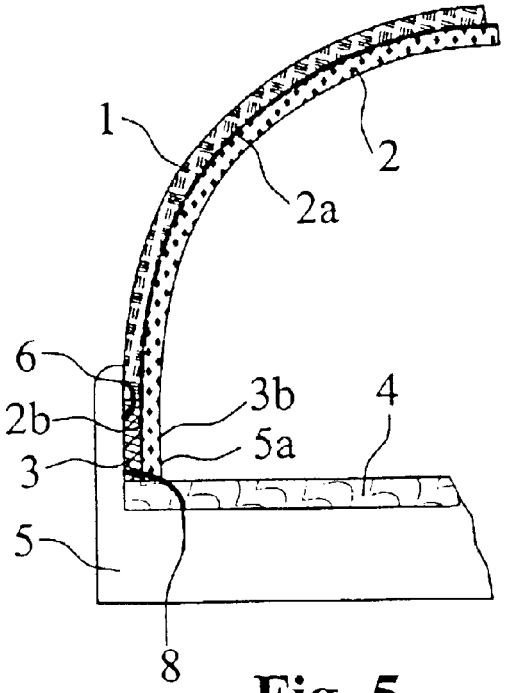
FIG. 5 represents a design according to an embodiment of the present invention in which the lining is joined to the insole.
Figure 6:
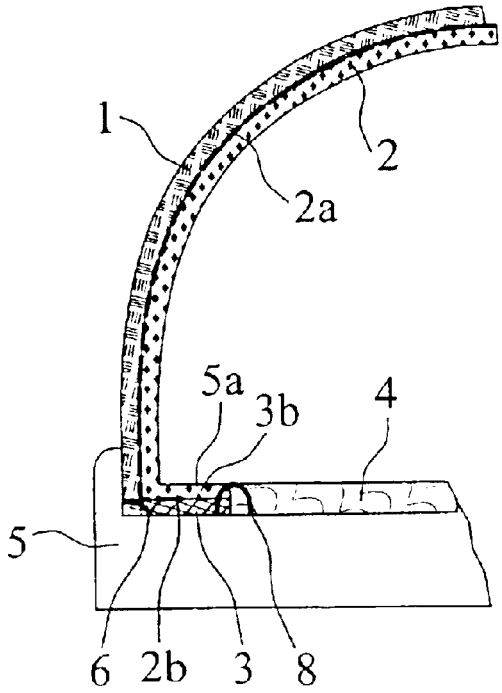
FIG. 6 represents a design for low-rise soles according to an embodiment of the present invention, wherein the lining is joined to the insole.

FIG. 5 shows another embodiment of the present invention, wherein a laminate comprising the lining 2 and the functional layer 2*a* extends beyond the upper 1, and the lining 2 extends as far as the insole to which it is joined by seam 8. In this embodiment, the lining 2 is longer than the functional layer 2*a*. This can be achieved in a laminate by removing part of the functional layer 2*a*, e.g., by shaving it off. The material of the sole penetrates as far as the functional layer 2*a*, and encloses an edge of the functional layer in a region 2*b*. The material of the sole 5*a* also penetrates the lining in the area 3*b*, so that, particularly where the material of the sole has an antistatic finish, electrical conductivity is assured up to the interior of the shoe. For better functionality, however, it may be advantageous to make the lining, at least in the region 3*b*, or the insole 4, antistatic. For designs with low-rise soles, as shown in FIG. 6, the extension 3 of the upper, functional layer 2*a*, and lining 2 are again turned inward in the region of the sole and point in the direction of insole 4.

Figure 7:
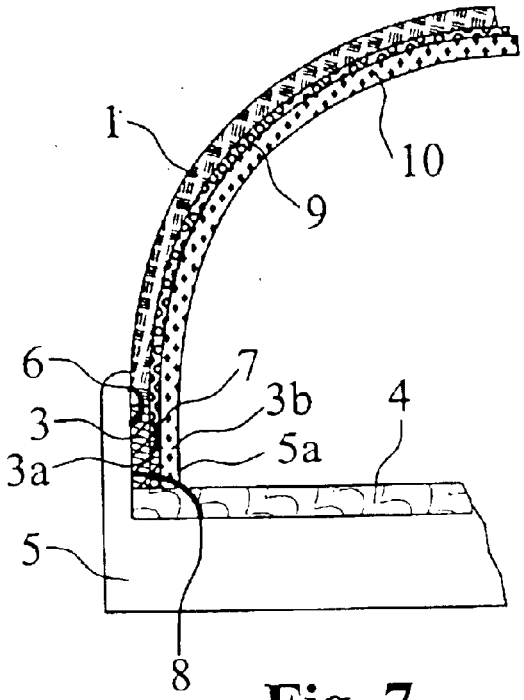
FIG. 7 represents a design according to an embodiment of the present invention with a separately inserted functional layer, wherein the functional layer is joined to its own extension.
Figure 8:
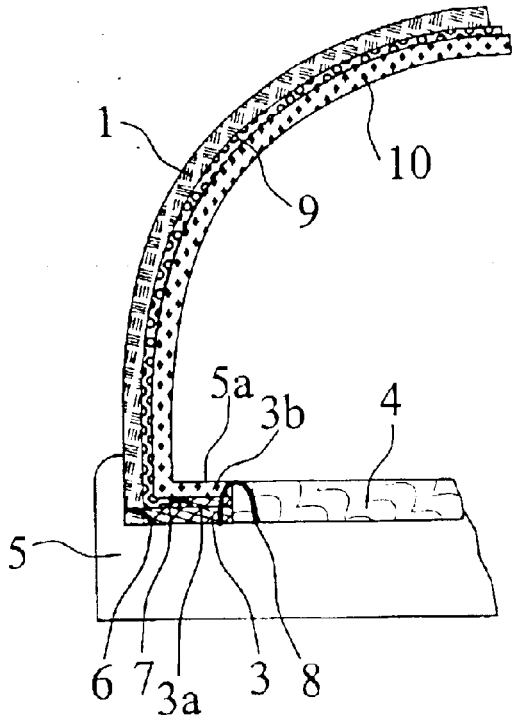
FIG. 8 is a design for low-rise soles according to an embodiment of the present invention having a separately inserted functional layer, wherein the functional layer is joined to its own extension.

FIG. 7 shows another embodiment of the invention, wherein a functional layer 9 and a lining 10 have been separately inserted into an upper 1. The functional layer 9 and the lining 10 may be joined to each other again after insertion by means of, for example, gluing points on the functional layer 9 and/or the lining 10. Such gluing points can be activated by heat. In the embodiment shown in FIG. 7, the functional layer 9 is attached to extension 3*a* of the functional layer by a seam 7. The extension 3 of the upper, functional-layer extension 3*a*, and lining 10 are joined to the insole 4 by seam 8. FIG. 8, in turn, shows a similar embodiment for designs with low-rise soles.

Figure 9:
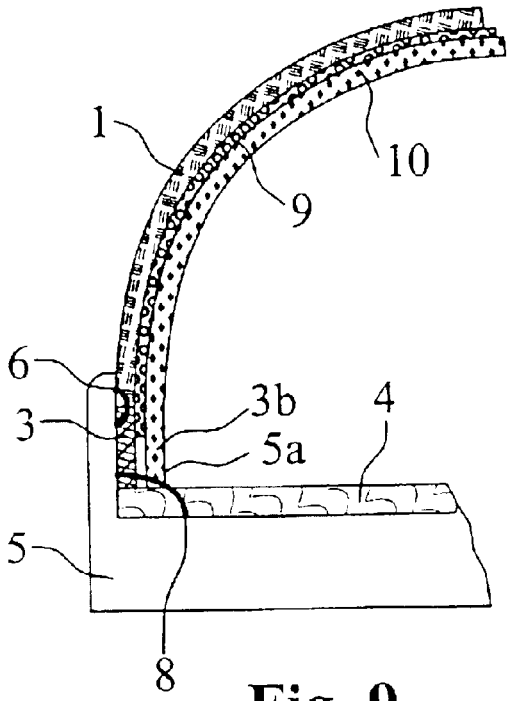
FIG. 9 represents another design according to an embodiment of the present invention having a separately inserted functional layer.
Figure 10:
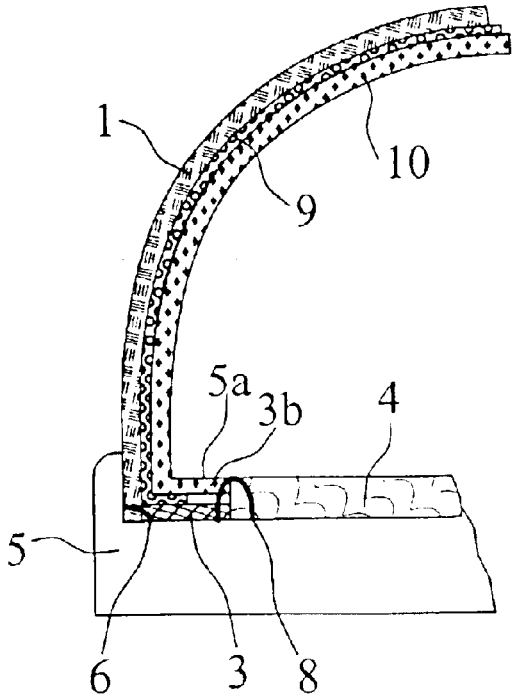
FIG. 10 is a design for low-rise soles according to an embodiment of the present invention having a separately inserted functional layer.

FIG. 9 shows another embodiment of the present invention, wherein the functional layer 9 and the lining 10 have been inserted separately into the upper. In the most basic case, a lower edge of functional layer 9 can be left unattached. Alternatively, the lower edge of the functional layer can be glued to the lining 10 or joined to the extension 3 of the upper, e.g., by a seam (not shown). FIG. 10, in turn, shows a similar embodiment for designs with low-rise soles.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention.

What is claimed is:

1. A shoe structure having an upper comprising an outer material, a waterproof and water vapor permeable functional layer, a lining, an insole, and a sole, the upper having an extension comprising a porous, permeable material, and the insole being joined to the extension, wherein the functional layer and the lining extend beyond a lower edge of the upper and only partially overlap the extension of the upper, the functional layer being spaced from an edge of the insole, the extension of the upper being penetrated by material of the sole, a part of the functional layer extending beyond the lower edge of the upper being joined to the material of the sole, and a space between the functional layer and the edge of the insole being filled with the material of the sole as far as the interior of the shoe structure.

2. A shoe structure according to claim 1, wherein the sole is injection-molded.

3. The shoe structure according to claim 1, wherein the part of the functional layer extending beyond the lower edge of the upper is joined to the extension of the upper.

4. The shoe structure according to claim 1, wherein the part of the functional layer extending beyond the lower edge of the upper is attached to a further extension of the lining comprising a porous, permeable material which is joined to the insole.

5. The shoe structure according to claim 1, wherein the material of the sole has undergone antistatic finishing.

6. The shoe structure according to claim 1, wherein the insole has undergone antistatic finishing, at least in the region of the edge.

7. The shoe structure according to claim 1, wherein the material of the sole penetrates the lining.

8. The shoe structure according to claim 1, wherein the material of the sole envelops the edge of the functional layer.

9. The shoe structure according to claim 1, wherein the seam joining the extension of the upper to the insole is completely enveloped at least up to the lining in a region wherein the seam penetrates the extension of the upper.

10. The shoe structure according to claim 1, wherein the extension of the upper, the functional layer, and the lining are turned inward in the region of the sole and point in a direction of the insole.

11. The shoe structure according to claim 1, wherein the functional layer is joined to the lining.

12. A shoe structure having an upper comprising an outer material, a waterproof and water vapor permeable functional layer, a lining, an insole, and a sole, the upper having an extension comprising a porous, permeable material, and the insole being joined to the extension of the upper, wherein the functional layer and the lining extend beyond a lower edge of the upper and only partially overlap the extension, the functional layer being spaced from the edge of the insole, the extension of the upper being penetrated by material of the sole, a part of the functional layer extending beyond the lower edge of the upper being joined to the material of the sole, the lining bridging a space between the functional layer and an edge of the insole and is joined to the insole, and the space between the functional layer and the edge of the insole is filled as far as the lining with the material of the sole, which is joined to the lining.

13. A shoe structure according to claim 12, wherein the sole is injection-molded.

14. The shoe structure according to claim 12, wherein the material of the sole has undergone antistatic finishing.

15. The shoe structure according to claim 12, wherein the insole has undergone antistatic finishing, at least in the region of the edge.

16. The shoe structure according to claim 12, wherein the material of the sole penetrates the lining.

17. The shoe structure according to claim 12, wherein the material of the sole envelops the edge of the functional layer.

18. The shoe structure according to claim 12, wherein the seam joining the extension of the upper to the insole is completely enveloped to at least up to the lining in a region wherein the seam penetrates the extension of the upper.

19. The shoe structure according to claim 12, wherein the extension of the upper, the functional layer, and the lining are turned inward in the region of the sole and point in a direction of the insole.

20. The shoe structure according to claim 12, wherein the functional layer is joined to the lining.

21. A method of manufacturing a shoe structure having an upper comprising an outer material, a waterproof and water vapor permeable functional layer, a lining, an insole, and a sole, the upper having an extension comprising a porous, permeable material, comprising:

joining the insole to the extension, wherein the functional layer and the lining extend beyond a lower edge of the upper and only partially overlap the extension of the upper;

extending a part of the functional layer beyond the lower edge of the upper joined to the material of the sole; and filling a space between the functional layer and the edge of the insole with the material of the sole as far as the interior of the shoe structure, wherein the material of the sole penetrates the extension of the upper.

22. The method of manufacturing a shoe structure according to claim 21, further comprising injecting-molding the sole.

23. The method of manufacturing a shoe structure according to claim 21, further comprising subjecting the material of the sole to antistatic finishing.

24. The method of manufacturing a shoe structure according to claim 21, further comprising subjecting the insole to antistatic finishing.

25. A method of manufacturing a shoe structure having an upper comprising an outer material, a waterproof and water vapor permeable functional layer, a lining, an insole, and a sole, the upper having an extension comprising a porous, permeable material, comprising:

joining the insole to the extension of the upper, wherein the functional layer and the lining extend beyond a lower edge of the upper and only partially overlap the extension;

extending a part of the functional layer beyond the lower edge of the upper joined to the material of the sole;

bridging a space between the functional layer and an edge of the insole with the lining;

joining the lining to the insole; and filling the space between the functional layer and the edge of the insole as far as the lining with the material of the sole, wherein the material of the sole penetrates the extension of the upper and is joined to the lining.

26. The method of manufacturing a shoe structure according to claim 25, wherein the sole is injection-molded.

27. The method of manufacturing a shoe structure according to claim 25, wherein the material of the sole has undergone antistatic finishing.

28. The method of manufacturing a shoe structure according to claim 25, wherein the insole has undergone antistatic finishing.

* * * * *